US007950369B2

(12) United States Patent
Morita et al.

(10) Patent No.: US 7,950,369 B2
(45) Date of Patent: May 31, 2011

(54) INTERNAL COMBUSTION ENGINE CONTROLLING APPARATUS

(75) Inventors: Koji Morita, Mishima (JP); Yusuke Nakayama, Gotenba (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 108 days.

(21) Appl. No.: 12/450,345

(22) PCT Filed: Feb. 15, 2008

(86) PCT No.: PCT/JP2008/053005

§ 371 (c)(1),
(2), (4) Date: Sep. 22, 2009

(87) PCT Pub. No.: WO2008/136206

PCT Pub. Date: Nov. 13, 2008

(65) Prior Publication Data

US 2010/0037860 A1 Feb. 18, 2010

(30) Foreign Application Priority Data

Apr. 26, 2007 (JP) ..... 2007-116386

(51) Int. Cl.
*F02P 5/00* (2006.01)
*F02M 7/28* (2006.01)
*F02D 41/06* (2006.01)

(52) U.S. Cl. ..... 123/406.53; 123/406.55; 123/435; 123/676

(58) Field of Classification Search ..... 123/435, 123/305, 491, 672, 676, 685, 406.44, 406.45, 123/406.47, 406.53, 406.55; 60/274, 285, 60/286

See application file for complete search history.

(56) References Cited

U.S. PATENT DOCUMENTS 4,351,297 A * 9/1982 Suematsu ..... 123/406.53
4,570,596 A * 2/1986 Sato ..... 123/406.55

(Continued)

FOREIGN PATENT DOCUMENTS

EP 1 013 923 A2 6/2000

(Continued)

OTHER PUBLICATIONS

Japanese Office Action issued in patent application No. 2007-116386, dated Oct. 19, 2010 (with partial translation).

*Primary Examiner* — Hai H Huynh
(74) *Attorney, Agent, or Firm* — Oliff & Berridge, PLC

(57) ABSTRACT

In a predetermined low-temperature startup state (in a rich atmosphere), in principle, over-advanced ignition control for advancing ignition timing beyond MBT and intake-synchronized injection control for causing the entire amount of to-be-injected fuel to undergo intake-synchronized injection are executed. Thus, the peak of intra-cylinder temperature increases, and the amount of port-adhering fuel decreases, whereby the emission amount of unburnt HC can be reduced. However, when the PM emission amount exceeds a PM permissible amount, instead of the intake-synchronized injection control, there is performed processing for causing a portion of the to-be-injected fuel to undergo intake-unsynchronized injection and causing the remaining fuel to undergo intake-synchronized injection. Thus, the amount of intra-cylinder-adhering fuel decreases, and the partial oxidation reaction of the intra-cylinder-adhering fuel, which is a cause of generation of PM, is suppressed. As a result, the PM emission amount decreases, whereby the PM emission amount can be suppressed to the PM permissible amount.

7 Claims, 8 Drawing Sheets

U.S. PATENT DOCUMENTS

| | | | | |
|---|---|---|---|---|
| 6,334,431 | B1 | 1/2002 | Kanehiro et al. | |
| 7,017,548 | B2 * | 3/2006 | Sawada et al. | 123/339.11 |

FOREIGN PATENT DOCUMENTS

| | | | |
|---|---|---|---|
| JP | A 2000-240547 | | 9/2000 |
| JP | A 2004-092542 | | 3/2004 |
| JP | 2004-225658 | * | 8/2004 |
| JP | 2006-2618 | * | 1/2006 |
| JP | A-2006-144609 | | 6/2006 |
| JP | A 2007-040259 | | 2/2007 |
| JP | A 2007-064132 | | 3/2007 |
| JP | B2 4232818 | | 3/2009 |

* cited by examiner

INTERNAL COMBUSTION ENGINE CONTROLLING APPARATUS

TECHNICAL FIELD

The present invention relates to a control apparatus for a spark-ignition-type internal combustion engine which performs an HC reduction control for reducing the emission amount of unburnt HC in a predetermined low-temperature startup state, and more particularly to suppression of an increase in the emission amount of PM (particulate matter) that would otherwise occur as a result of execution of the HC reduction control.

BACKGROUND ART

Conventionally, for a spark-ignition-type internal combustion engine, there has been known a technique of performing a control of advancing the ignition timing beyond MBT (Minimum spark advance for Best Torque; ignition timing at which the maximum torque can be obtained) (hereinafter referred to as "over-advanced ignition control") at the time of low-temperature startup (at the time of cold startup) (e.g., Japanese Patent Application Laid-Open (kokai) No. 2000-240547). When the over-advanced ignition control is performed, as compared with the case where the ignition timing is set to the MBT (hereinafter referred to as "MBT control"), the temperature (peak temperature) within a combustion chamber rises, whereby the temperature of cooling water rises more quickly, and, thus, warming up of an engine at the time of startup thereof can be performed in an improved manner.

DISCLOSURE OF THE INVENTION

At the time of low-temperature startup, the temperature within a combustion chamber (hereinafter referred to as "intra-cylinder temperature") is low. Accordingly, fuel injected into an intake passage located upstream of an intake valve is apt to adhere to the wall surface of the combustion chamber. The greater portion of the fuel adhering to the wall surface of the combustion chamber (hereinafter referred to as "intra-cylinder-adhering fuel") may be discharged from the combustion chamber in the form of unburnt HC, without being burnt. At that time, if the temperature of a catalyst disposed in an exhaust system of the internal combustion engine is low, the catalyst is in a non-activated state, so that the above-mentioned unburnt HC may be discharged to the atmosphere without being removed by the catalyst.

The present applicant has already found that, when such over-advanced ignition control is executed at the time of low-temperature startup (and in a rich atmosphere), the amount of unburnt HC discharged from the combustion chamber greatly decreases (see Japanese Patent Application No. 2006-322336). Presumably, the reduction of the emission amount of unburnt HC occurs for the following reason.

That is, when the over-advanced ignition control is executed, the peak of the pressure within the combustion chamber (hereinafter referred to as "intra-cylinder pressure") in compression and expansion strokes increases as compared with the case where MBT control is executed, whereby the peak of the intra-cylinder temperature rises (see FIG. 3 to be described later).

When the peak of the intra-cylinder temperature rises in the atmosphere within the combustion chamber having been adjusted by means of a so-called "startup enrichment" to an air-fuel ratio shifted slightly to the rich side, a "partial oxidation reaction" (incomplete combustion) occurring between oxygen, which tends to be insufficient, and the intra-cylinder-adhering fuel is accelerated. When such a partial oxidation reaction takes place, unburnt HC derived from the intra-cylinder-adhering fuel is converted to CO, which is then discharged from the combustion chamber. For the above-described reason, when the over-advanced ignition control is executed at the low-temperature startup, the emission amount of unburnt HC decreases remarkably.

Further, the present applicant has also found that the emission amount of unburnt HC can be decreased further by means of performing, at the time of low-temperature startup, the over-advanced ignition control and additionally a control for setting a fuel injection period such that the entire amount of fuel to be injected into an intake passage (intake port) located upstream of an intake valve is injected within an intake valve open period (hereinafter referred to as "intake-synchronized injection control"). Presumably, the further reduction of emission amount of unburnt HC occurs for the following reason. Notably, in the following description, fuel injection within the intake valve open period will be referred to as "intake-synchronized injection," and fuel injection before the intake valve open period will be referred to as "intake-unsynchronized injection."

At the time of low-temperature startup, not only the intra-cylinder temperature but also the temperature of the intake port is low. Accordingly, the injected fuel is apt to adhere not only to the wall surface of the combustion chamber but also to the wall surface of the intake port. The fuel adhering to the wall surface of the intake port (hereinafter referred to as "port-adhering fuel") may be discharged from the combustion chamber in the form of unburnt HC without being burnt.

When the intake-synchronized injection is performed, fuel is injected in a state where air within the intake passage is flowing into the combustion chamber via the intake port (a state where a flow of air is present). Accordingly, the amount of the port-adhering fuel can be reduced remarkably, as compared with the case where the intake-unsynchronized injection is executed. As a result, the emission amount of unburnt HC derived from the port-adhering fuel decreases remarkably.

Meanwhile, when the intake-synchronized injection is executed, the amount of the intra-cylinder-adhering fuel tends to increase, whereby the emission amount of unburnt HC derived from the intra-cylinder-adhering fuel may increase. However, the decrease in the above-mentioned "emission amount of unburnt HC derived from the port-adhering fuel" is considerably greater than the increase in the "emission amount of unburnt HC derived from the intra-cylinder-adhering fuel." For the above-described reason, when the intake-synchronized injection control is executed in addition to the over-advanced ignition control at the time of low-temperature startup, the emission amount of unburnt HC decreases further as a whole.

Incidentally, it has been found that, when the above-described partial oxidation reaction (incomplete combustion) of the intra-cylinder-adhering fuel is performed in the atmosphere within the combustion chamber whose air-fuel ratio is shifted slightly to the rich side and in which oxygen is insufficient, PM (particular matter composed of soot, SOF, etc.) is generated. Accordingly, when the partial oxidation reaction of the intra-cylinder-adhering fuel is accelerated by means of the over-advanced ignition control, the emission amount of PM increases, although the emission amount of unburnt HC decreases remarkably as described above.

Such a trend in which the emission amount of PM increases becomes particularly remarkable when the intake-synchronized injection control is executed in addition to the over-advanced ignition control. Presumably, this phenomenon occurs because the intake-synchronized injection increases the amount of the intra-cylinder-adhering fuel, which undergoes the above-describe partial oxidation reaction, whereby the partial oxidation reaction is accelerated.

As described above, when the over-advanced ignition control (and the intake-synchronized injection control) (hereinafter, also referred to as "HC reduction control") is executed, the problem of an increased emission amount of PM arises. Therefore, there has been desire for suppressing an increase in the emission amount of PM occurring as a result of execution of the HC reduction control.

Accordingly, an object of the present invention is to provide a control apparatus for a spark-ignition-type internal combustion engine which performs the HC reduction control in a predetermined low-temperature startup state, the control apparatus being capable of suppressing the increase in the emission amount of PM occurring as a result of execution of the HC reduction control.

A control apparatus for a spark-ignition-type internal combustion engine according to the present invention comprises determination means for determining whether or not the internal combustion engine is in a predetermined low-temperature startup state; and HC reduction means, operable when the internal combustion engine is determined to be in the predetermined low-temperature startup state, for performing an HC reduction control which raises a temperature within a combustion chamber of the internal combustion engine through adjustment of a predetermined engine control parameter, to thereby reduce the emission amount of unburnt HC.

For example, only the above-described over-advanced ignition control or both the above-described over-advanced ignition control and the above-described intake-synchronized injection control, etc. may be performed as the HC reduction control. Notably, in the predetermined low-temperature startup state, in general, the air-fuel ratio is adjusted to an air-fuel ratio shifted slightly from the stoichiometric air-fuel ratio toward the rich side so as to suppress misfire and stabilize combustion (so-called startup enrichment).

The control apparatus for a spark-ignition-type internal combustion engine according to the present invention is characterized by comprising permissible value acquisition means for acquiring a PM-emission-amount corresponding permissible value, which is a permissible value for a value corresponding to the emission amount of PM; and restriction means for performing a restriction control which restricts execution of the HC reduction control on the basis of the PM-emission-amount corresponding permissible value.

By virtue of this, since the execution of the HC reduction control is restricted on the basis of the PM-emission-amount corresponding permissible value, the HC reduction control can be performed within a range in which the emission amount of PM does not exceed the permissible value. That is, an increase in the PM emission amount caused by the execution of the HC reduction control can be suppressed.

Specifically, for example, in the case where only the above-described over-advanced ignition control or both the above-described over-advanced ignition control and the above-described intake-synchronized injection control, etc. are performed as the HC reduction control, as the restriction control, there can be performed a control of rendering the amount of advancement of the ignition timing from the MBT smaller than the amount of advancement by the over-advanced ignition control.

The greater the amount of advancement of the ignition timing from the MBT (hereinafter may be simply referred as the "advancement amount"), the higher the peak of the intra-cylinder pressure (according, the peak of the intra-cylinder temperature) and the greater the degree to which the partial oxidation reaction is accelerated. As a result, the emission amount of unburnt HC decreases, and the emission amount of PM increases. In other words, when the advancement amount is reduced, the emission amount of PM can be reduced.

Accordingly, in the case where the emission amount of PM is about to exceed the permissible value due to an increase in the advancement amount caused by the over-advanced ignition control, through setting the advancement amount to a somewhat smaller value, acceleration of the partial oxidation reaction caused by the increased peak of the intra-cylinder temperature can be suppressed so as to prevent the emission amount of PM from exceeding the permissible value. The above-described configuration is based on this finding.

Further, for example, in the case where both the above-described over-advanced ignition control and the above-described intake-synchronized injection control are executed as the HC reduction control, instead of the intake-synchronized injection control, there can be performed, as the restriction control, a control of setting the fuel injection period such that a portion (or the entirety) of the to-be-injected fuel is injected before the intake valve is opened.

As described above, when the intake-synchronized injection is executed, the amount of the intra-cylinder-adhering fuel, which undergoes the partial oxidation reaction, increases, whereby the partial oxidation reaction is accelerated and the emission amount of PM increases accordingly. In other words, the generation amount of PM can be reduced by means of reducing the amount of fuel which undergoes the intake-synchronized injection.

Accordingly, in the case where the emission amount of PM is about to exceed the permissible value due to simultaneous performance of the over-advanced ignition control and the intake-synchronized injection control, if the amount of fuel which undergoes the intake-synchronized injection is reduced by means of causing a portion or the entirely of the to-be-injected fuel to undergo the intake-unsynchronized injection, the acceleration of the partial oxidation reaction caused by an increase in the amount of the intra-cylinder-adhering fuel can be suppressed so as to prevent the emission amount of PM from exceeding the permissible value. The above-described configuration is based on this finding.

In this case, preferably, the permissible value acquisition means is configured to acquire, as the PM-emission-amount corresponding permissible value, an intra-cylinder-adhering-fuel-amount permissible value, which is a permissible value for the amount of the intra-cylinder-adhering fuel adhering to the wall surface of the combustion chamber, on the basis of the amount of advancement from the MBT by the over-advanced ignition control; and the restriction means is configured to determine, as an intake-synchronized-injection-amount permissible value, an amount of fuel injected within the intake valve open period corresponding to the case where the amount of the intra-cylinder-adhering fuel becomes equal to the intra-cylinder-adhering-fuel-amount permissible value, on the basis of the acquired intra-cylinder-adhering-fuel-amount permissible value and a relation between the amount of the to-be-injected fuel and the amount of the intra-cylinder-adhering fuel, the relation being previously obtained for the case where the intake-synchronized injection control is executed in the predetermined low-temperature startup state. When the entire amount of the to-be-injected fuel is greater than the intake-synchronized-injection-amount permissible value, the restriction means sets the fuel injection period such that the fuel is injected before the intake valve is opened in an amount obtained by subtracting the intake-synchronized-injection-amount permissible value from the entire amount of the to-be-injected fuel, and is injected within the intake valve open period in an amount equal to the intake-synchronized-injection-amount permissible value.

As described above, since the generation of PM is caused by the partial oxidation reaction of the intra-cylinder-adhering fuel, the greater the amount of the intra-cylinder-adhering fuel, the greater the emission amount of PM. Accordingly, the emission amount of PM can be reduced to the permissible value or less by means of reducing the amount of the intra-cylinder-adhering fuel to a certain value or less. That is, the permissible value for the amount of the intra-cylinder-adhering fuel can be used as the PM-emission-amount corresponding permissible value. Here, in consideration that the higher the intra-cylinder temperature (accordingly, the greater the advancement amount), the greater the degree of acceleration of the partial oxidation reaction of the intra-cylinder-adhering fuel, the permissible value for the amount of the intra-cylinder-adhering fuel can be determined on the basis of the advancement amount such that the greater the advancement amount, the smaller the value to which the permissible value is set.

Meanwhile, through an experiment, simulation, or the like, the relation between the amount of the to-be-injected fuel and the amount of the intra-cylinder-adhering fuel can be obtained in advance for the case where the intake-synchronized injection control (the entire amount of the to-be-injected fuel undergoes the intake-synchronized injection) is executed at the time of low-temperature startup. Accordingly, on the basis of this relation and the above-described permissible value for the amount of the intra-cylinder-adhering fuel, there can be determined the amount of fuel which undergoes the intake-synchronized injection and which corresponds to a case where the amount of the intra-cylinder-adhering fuel becomes equal to its permissible value (= the intake-synchronized-injection-amount permissible value).

Therefore, when the entire amount of the to-be-injected fuel exceeds the intake-synchronized-injection-amount permissible value, instead of performing the above-described intake-synchronized injection control, fuel of an amount obtained by subtracting the intake-synchronized-injection-amount permissible value from the entire amount of the to-be-injected fuel is subjected to the intake-unsynchronized injection, and fuel of an amount equal to the intake-synchronized-injection-amount permissible value is subjected to the intake-synchronized injection as in the above-described configuration. Thus, the amount of the intra-cylinder-adhering fuel is prevented from increasing from its permissible value, whereby the emission amount of PM can be prevented from exceeding the permissible value.

In the case where, as described above, the intra-cylinder-adhering-fuel-amount permissible value is acquired as the PM-emission-amount corresponding permissible value on the basis of the advancement amount, for example, the intra-cylinder-adhering-fuel-amount permissible value can be obtained on the basis of a "base value of the intra-cylinder-adhering-fuel-amount permissible value corresponding to the case where the ignition timing is MBT (advancement amount=0)," which is obtained on the basis of the temperature of cooling water of the internal combustion engine, and a "first correction value for the intra-cylinder-adhering-fuel-amount permissible value," which is obtained on the basis of the advancement amount.

For example, the base value of the intra-cylinder-adhering-fuel-amount permissible value is set such that the higher the temperature of the cooling water, the greater the base value, in consideration that, when the temperature of the cooling water rises, the ratio of a portion of the intra-cylinder-adhering fuel that evaporates and undergoes combustion increases, whereby the ratio of a portion of the intra-cylinder-adhering fuel that substantially undergoes the partial oxidation reaction decreases (that is, the generation amount of PM decreases).

For example, the above-mentioned first correction value is set such that the greater the advancement amount, the smaller the intra-cylinder-adhering-fuel-amount permissible value, in consideration that, when the advancement angle increases, the peak of the intra-cylinder temperature rises, and the partial oxidation reaction is accelerated (that is, the generation amount of PM increases).

Moreover, when the base value of the intra-cylinder-adhering-fuel-amount permissible value is set to a value corresponding to the case where the ignition timing is the MBT and the air-fuel ratio is the stoichiometric air-fuel ratio, the intra-cylinder-adhering-fuel-amount permissible value can be obtained on the basis of the base value of the intra-cylinder-adhering-fuel-amount permissible value, the first correction value, and a "second correction value for the intra-cylinder-adhering-fuel-amount permissible value," which is obtained on the basis of the air-fuel ratio.

For example, the second correction value is set such that the greater the deviation of the air-fuel ratio from the stoichiometric air-fuel ratio to the rich side, the smaller the intra-cylinder-adhering-fuel-amount permissible value, in consideration that, when the deviation of the air-fuel ratio from the stoichiometric air-fuel ratio to the rich side increases, the amount of the intra-cylinder-adhering fuel increases, whereby the partial oxidation reaction is accelerated (that is, the generation amount of PM increases).

BEST MODE FOR CARRYING OUT THE INVENTION

A control apparatus for an internal combustion engine according to an embodiment of the present invention will be described with reference to the drawings.

Figure 1:
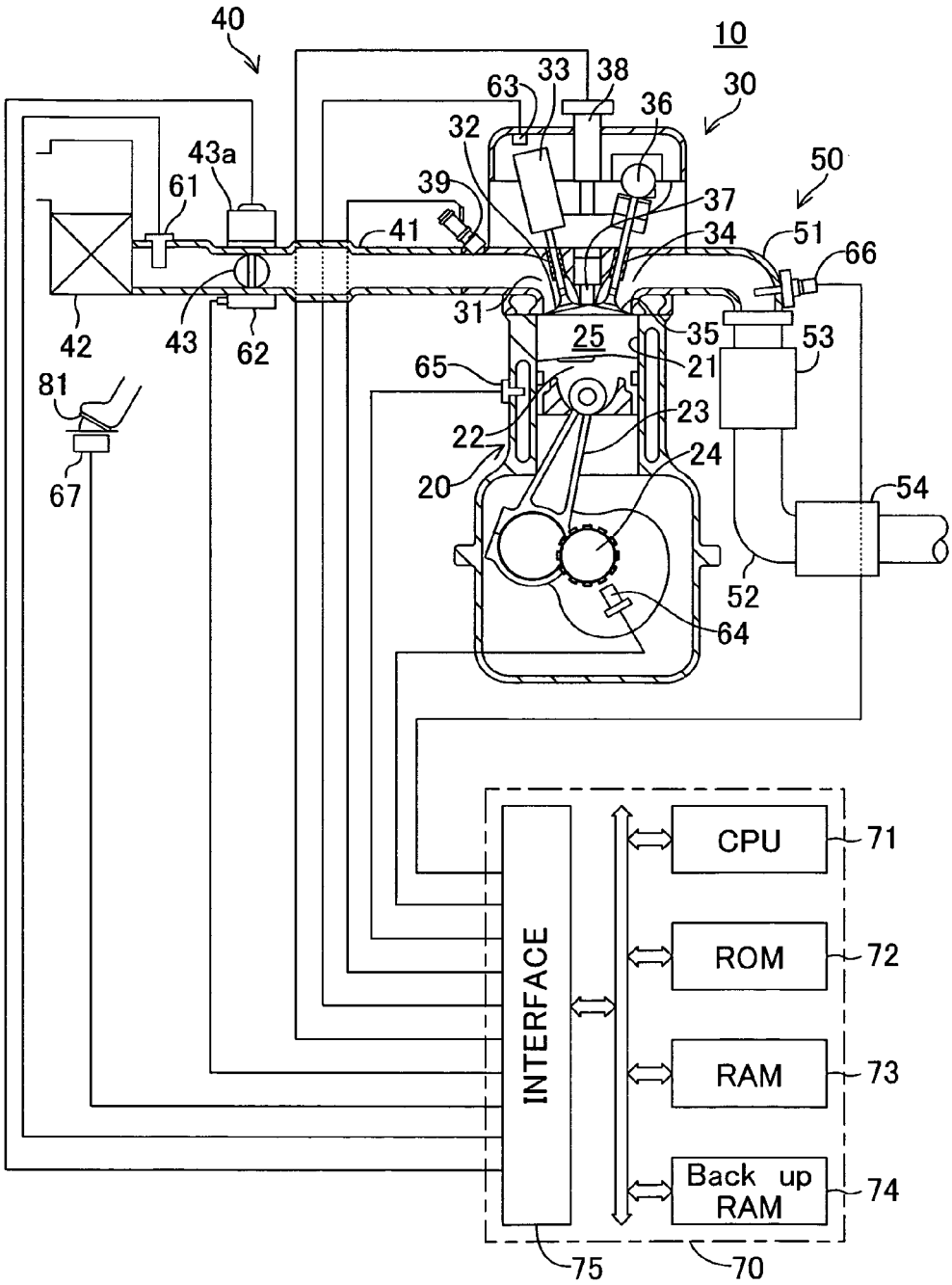
FIG. 1 is a schematic diagram of an internal combustion engine to which a control apparatus for a spark-ignition-type internal combustion engine according to an embodiment of the present invention is applied.

FIG. 1 schematically shows the configuration of a system configured such that a control apparatus according to the embodiment of the present invention is applied to a spark-ignition multi-cylinder (4-cylinder) four-cycle internal combustion engine 10. This internal combustion engine 10 includes a cylinder block section 20 including a cylinder block, a cylinder block lower-case, an oil pan, etc.; a cylinder head section 30 fixed on the cylinder block section 20; an intake system 40 for supplying gasoline gas mixture to the cylinder block section 20; and an exhaust system 50 for discharging exhaust gas from the cylinder block section 20 to the exterior of the engine.

The cylinder block section 20 includes cylinders 21, pistons 22, connecting rods 23, and a crankshaft 24. Each of the pistons 22 reciprocates within the corresponding cylinder 21. The reciprocating motion of the piston 22 is transmitted to the crankshaft 24 via the respective connecting rod 23, whereby the crankshaft 24 is rotated. The cylinder 21 and the head of the piston 22 form a combustion chamber 25 in cooperation with the cylinder head section 30.

The cylinder head section 30 includes an intake port 31 communicating with the combustion chamber 25; an intake valve 32 for opening and closing the intake port 31; an intake-valve control apparatus 33 for driving the intake valve 32 so as to open and close the intake port; an exhaust port 34 communicating with the combustion chamber 25; an exhaust valve 35 for opening and closing the exhaust port 34; an exhaust cam shaft 36 for driving the exhaust valve 35; a spark plug 37; an igniter 38 including an ignition coil for generating a high voltage to be applied to the spark plug 37; and an injector (fuel injection means) 39 for injecting fuel into the intake port 31.

The intake-valve control apparatus 33 has a known structure for hydraulically adjusting and controlling a relative rotational angle (phase angle) between an intake cam shaft and an intake cam (not shown). Therefore, the intake-valve control apparatus 33 can adjust open timing WT (open and close timings) of the intake valve 32.

The intake system 40 includes an intake pipe 41 which includes an intake manifold communicating with the intake port 31 and forming an intake passage in cooperation with the intake port 31; an air filter 42 provided at an end portion of the intake pipe 41; a throttle valve 43 provided within the intake pipe 41 and adapted to change the opening cross sectional area of the intake passage; and a throttle valve actuator (throttle valve drive means) 43*a* composed of a DC motor.

The exhaust system 50 includes an exhaust manifold 51 communicating with the exhaust port 34; an exhaust pipe 52 connected to the exhaust manifold 51; an upstream three-way catalyst 53 disposed (interposed) in the exhaust pipe 52; and a downstream three-way catalyst 54 disposed (interposed) in the exhaust pipe 52 to be located downstream of the first catalyst 53. The exhaust port 34, the exhaust manifold 51, and the exhaust pipe 52 constitute an exhaust passage.

Meanwhile, this system includes a hot-wire air flowmeter 61; a throttle position sensor 62; an intake-cam rotational angle sensor 63; a crank position sensor 64; a water temperature sensor 65; an air-fuel ratio sensor 66 disposed in the exhaust passage to be located upstream of the first catalyst 53; and an accelerator opening sensor 67.

The hot-wire air flowmeter 61 detects the mass flow rate (per unit time) of intake air flowing through the intake pipe 41, and outputs a signal representing the detected mass flow rate (intake air flow rate) Ga. The throttle position sensor 62 detects the opening of the throttle valve 43, and outputs a signal representing the detected throttle valve opening TA. The intake-cam rotational angle sensor 63 detects the rotational angle of the intake cam, and outputs a signal representing open timing VVT of the intake valve 32. The crank position sensor 64 detects the rotational angle of the crank shaft 24, and outputs a signal representing engine rotational speed NE. The water temperature sensor 65 detects the temperature of cooling water, and outputs a signal representing the detected cooling water temperature THW.

The air-fuel ratio sensor 66 detects the air-fuel ratio on the upstream side of the first catalyst 53, and output a signal representing the detected air-fuel ratio. The accelerator opening sensor 67 detects an operation amount of an accelerator pedal 81 operated by a driver, and outputs a signal representing the detected operation amount Accp of the accelerator pedal 81.

An electric controller 70 is a microcomputer, which includes the following mutually bus-connected elements: a CPU 71; ROM 72 in which routines (programs) to be executed by the CPU 71, tables (lookup tables, maps), constants, and the like are stored in advance; RAM 73; backup RAM 74; and an interface 75 including an AD converter. The interface 75 is connected to the sensors 61 to 67. Signals from the sensors 61 to 67 are supplied to the CPU 71 via the interface 75. In accordance with instructions from the CPU 71, the interface 75 sends out drive signals to the intake-valve control apparatus 33, the igniter 38, the injector 39, and the throttle valve actuator 43*a*.

(HC Reduction Control)

Next, a control for reducing the emission amount of unburnt HC (HC reduction control), which is performed by the control apparatus for the internal combustion engine 10, configured as described above (hereinafter referred to as the "present apparatus") will be described briefly. Notably, this HC reduction control is described in detail in Japanese Patent Application No. 2006-322336.

At the time of low-temperature startup, the temperature within the combustion chamber (intra-cylinder temperature) is low. Accordingly, the fuel injected from the injector 39 toward the intake port 31 is apt to adhere to the wall surface of the combustion chamber 25. The greater portion of the fuel adhering to the wall surface of the combustion chamber 25 (intra-cylinder-adhering fuel) is discharged from the combustion chamber 25 in the form of unburnt HC without being burnt. In addition, at the time of low-temperature startup, the temperatures of the three-way catalysts 53 and 54 are low, and each of the three-way catalysts 53 and 54 is in a non-activated state. Accordingly, the unburnt HC discharged from the combustion chamber 25 may be emitted to the atmosphere without being removed by the three-way catalysts 53 and 54.

The present apparatus performs over-advanced ignition control and intake-synchronized injection control, as the HC reduction control, so as to reduce the emission amount of unburnt HC (hereinafter also referred to as the "HC emission amount") in a predetermined low-temperature startup state (which will be described later). First, the over-advanced ignition control will be described.

<Over-Advanced Ignition Control>

The present applicant has already found that, through execution of control of advancing the ignition timing beyond MBT (over-advanced ignition control) at the time of low-temperature startup (and in a rich atmosphere), the emission amount of unburnt HC (hereinafter also referred to as the "HC emission amount") decreases remarkably. This will now be described with reference to FIGS. 2 and 3.

Figure 2:
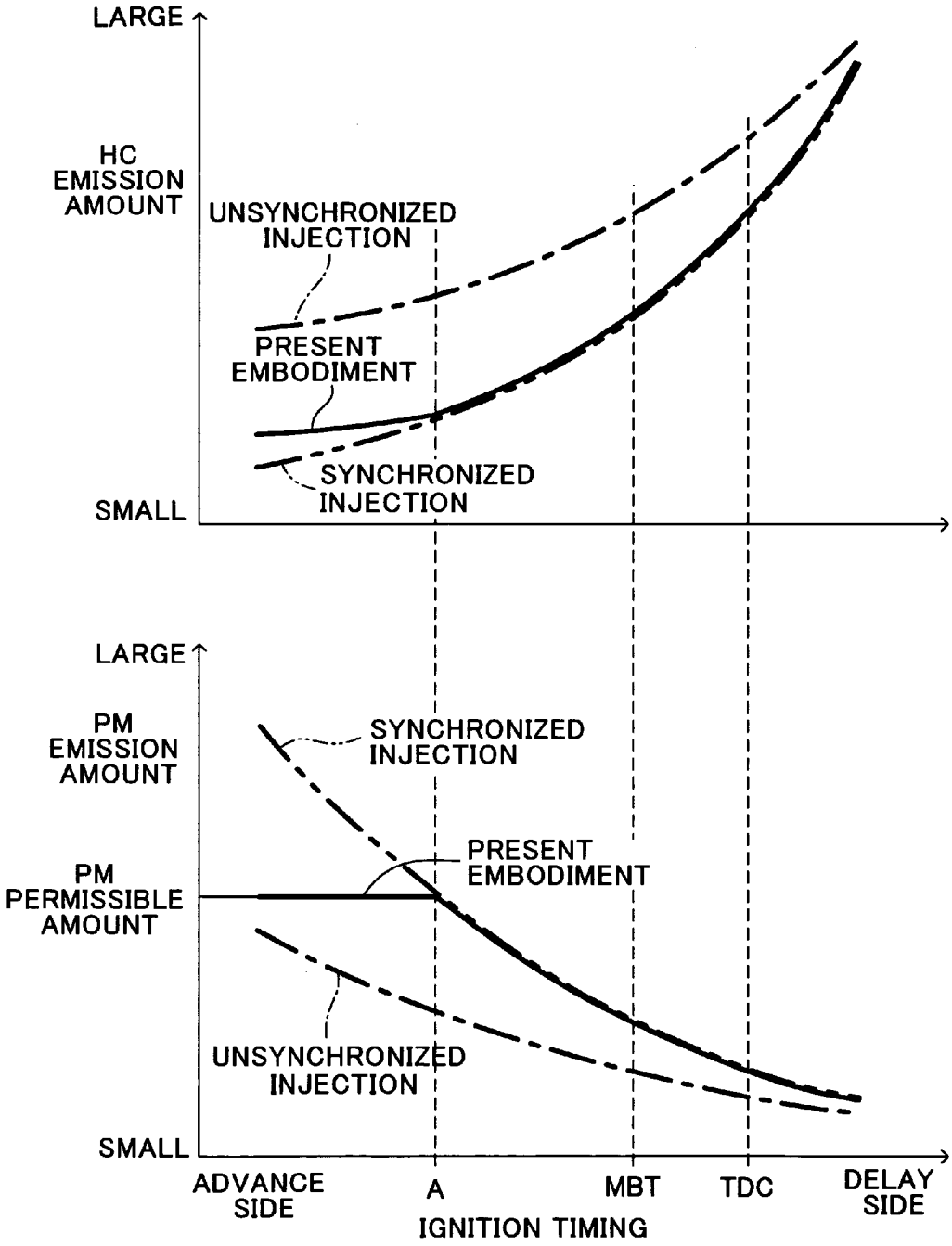
FIG. 2 is a pair of graphs showing an example relation between ignition timing, and HC emission amount and PM emission amount for the case where the engine is started at a low temperature and the air-fuel ratio is on the rich side.

The upper graph of FIG. 2 shows an example relation between the ignition timing and the HC emission amount at the time of low-temperature startup, at which the air-fuel ratio is on the rich side. As is apparent from the upper graph of FIG. 2, as the ignition timing is advanced, the HC emission amount decreases. That is, when the over-advanced ignition control is performed, the HC emission amount decreases, as compared with the case where the ignition timing is set to MBT (MBT control). Presumably, such a phenomenon occurs for the following reason.

Figure 3:
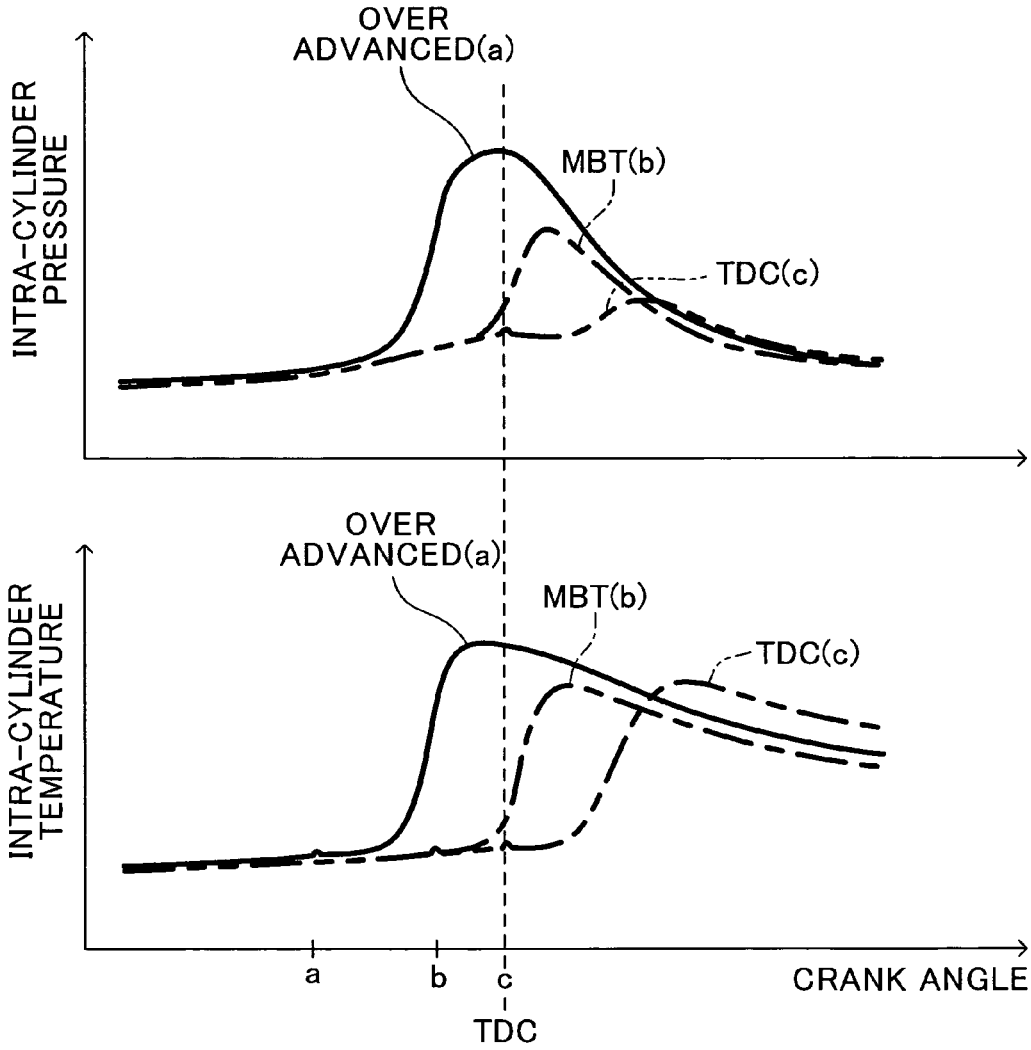
FIG. 3 is a pair of graphs showing changes in intra-cylinder pressure and intra-cylinder temperature with crank angle in compression and expansion strokes.

FIG. 3 is a pair of graphs showing changes in intra-cylinder pressure and intra-cylinder temperature with crank angle in compression and expansion strokes. As is apparent from the upper graph of FIG. 3, when the ignition timing is advanced (c→b→a), the peak of the intra-cylinder pressure increases. This phenomenon occurs because the greater the amount of advancement of the ignition timing, the greater the amount of fuel burnt before the compression top dead center and the greater the degree of the "pressure increasing action due to combustion of fuel" which is superimposed on the "pressure increasing action due to an upward motion (motion from the bottom dead center to the top dead center) of the piston 22." As a result, as is apparent from the lower graph of FIG. 3, when the ignition timing is advanced (c→b→a), the peak of the intra-cylinder temperature also rises with an increase in the peak of the intra-cylinder pressure.

Meanwhile, at the time of low-temperature startup, in order to suppress misfire to thereby stabilize combustion, the air-fuel ratio is adjusted to an air-fuel ratio shifted slightly from the stoichiometric air-fuel ratio toward the rich side (so-called startup enrichment). When the peak of the intra-cylinder temperature rises in the atmosphere within the combustion chamber having been adjusted to an air-fuel ratio shifted slightly to the rich side, a "partial oxidation reaction" (incomplete combustion) occurring between oxygen, which tends to be insufficient, and the intra-cylinder-adhering fuel is accelerated.

When such a partial oxidation reaction takes place, unburnt HC derived from the intra-cylinder-adhering fuel is converted to CO, which is then discharged from the combustion chamber 25. For the above-described reason, the greater the amount of advancement of the ignition timing (accordingly, the higher the peak of the intra-cylinder temperature), the greater the degree to which the partial oxidation reaction is accelerated, whereby the HC emission amount decreases.

In view of the above, in the predetermined low-temperature startup state, the present apparatus executes the over-advanced ignition control as one HC reduction control. Setting of the amount of advancement of the ignition timing from MBT, which is performed during execution of the over-advanced ignition control, will be described when a flowchart is described later.

<Intake-Synchronized Injection Control>

Next, the intake-synchronized injection control will be described. The present applicant has also found that the HC emission amount can be decreased further by means of performing, at the time of low-temperature startup, the over-advanced ignition control and additionally a control for setting a fuel injection period such that all the fuel injected from the injector 39 is injected within an intake valve open period (intake-synchronized injection control). Presumably, the further reduction of the HC emission amount occurs for the following reason. Notably, in the following description, in order to facilitate description and understanding, fuel injection within the intake valve open period will be referred to as "intake-synchronized injection," and fuel injection before the intake valve open period will be referred to as "intake-unsynchronized injection."

At the time of low-temperature startup, not only the intra-cylinder temperature but also the temperature of the intake port 31 is low. Accordingly, the injected fuel is apt to adhere not only to the wall surface of the combustion chamber 25 but also to the wall surface of the intake port 31. The fuel adhering to the wall surface of the intake port 31 (port-adhering fuel) may be discharged from the combustion chamber 25 in the form of unburnt HC without being burnt.

When the intake-unsynchronized injection is performed, fuel is injected in a state where the intake valve 32 is closed (that is, in a state where a flow or intake air is not present), so that the injected fuel is likely to adhere to the wall surface of the intake port 31. In contrast, when the intake-synchronized injection is performed, fuel is injected in a state where the intake valve 32 is opened (that is, in a state where a flow of intake air from the intake portion 31 into the combustion chamber 25 is present), so that the injected fuel is unlikely to adhere to the wall surface of the intake port 31.

Accordingly, through execution of the intake-synchronized injection, the amount of the port-adhering fuel can be reduced remarkably, as compared with the case where the intake-unsynchronized injection is executed. As a result, the emission amount of HC derived from the port-adhering fuel decreases remarkably.

Meanwhile, when the intake-synchronized injection is executed, the amount of the intra-cylinder-adhering fuel tends to increase, whereby the emission amount of HC derived from the intra-cylinder-adhering fuel tends to increase. However, the decrease in the above-described "emission amount of HC derived from the port-adhering fuel" is considerably greater than the increase in the "emission amount of HC derived from the intra-cylinder-adhering fuel."

Therefore, as shown in the upper graph of FIG. 2, in the case where the intake-synchronized injection control is executed (see an alternate long and two short dashes line), the HC emission amount decreases further as a whole, as compared with the case where the intake-unsynchronized injection control is executed (see an alternate long and short dash line).

In view of the above, in principle, the present apparatus executes, as one HC reduction control, the intake-synchronized injection control, in addition to the over-advanced ignition control, in the predetermined low-temperature startup state. In the present example, at the time of the intake-synchronized injection control, the start point of the fuel injection period is set to coincide with a point in time at which the intake valve 32 is opened (a point in time when the intake valve 32 is brought into an open state from a closed state).

(Suppression of PM Emission)

As having already been described, when the ignition timing is advanced by the over-advanced ignition control in a slightly rich atmosphere at the time of low-temperature startup, due to the increased peak of the intra-cylinder temperature, the above-mentioned partial oxidation reaction of the intra-cylinder-adhering fuel is accelerated, whereby the HC emission amount decreases. However, it has been found that, due to the partial oxidation reaction of the intra-cylinder-adhering fuel, PM is generated.

That is, as shown in the lower graph of FIG. 2, when the ignition timing is advanced, due to the increased peak of the intra-cylinder temperature, the above-mentioned partial oxidation reaction of the intra-cylinder-adhering fuel is accelerated (the amount of the partial oxidation reaction increases), whereby the emission amount of PM (hereinafter may be simply referred to as the "PM emission amount") increases.

In addition, the PM emission amount tends to increase in the case where the intake-synchronized injection control is executed (see an alternate long and two short dashes line), as compared with the case where the intake-unsynchronized injection control is executed (see an alternate long and short dash line). Presumably, this tendency occurs because the amount of the intra-cylinder-adhering fuel, which undergoes the partial oxidation reaction, increases as a result of execution of the intake-synchronized injection, whereby the partial oxidation reaction is accelerated further (the amount of the partial oxidation reaction increases).

When the HC reduction control (the over-advanced ignition control+the intake-synchronized injection control) is performed, the PM emission amount increases. An increase in the PM emission amount must be suppressed such that the PM emission amount does not exceed a predetermined permissible value (PM permissible amount; see the lower graph of FIG. 2). An increase in the PM emission amount can be suppressed by means of suppressing the partial oxidation reaction of the intra-cylinder-adhering fuel (reducing the amount of the partial oxidation reaction).

One possible method for suppressing the partial oxidation reaction of the intra-cylinder-adhering fuel is suppression of an increase in the amount of the intra-cylinder-adhering fuel. This can be achieved by means of restricting the amount of fuel which undergoes the intake-synchronized injection.

In view of the above, in the case where the PM emission amount is about to exceed the PM permissible amount due to simultaneous execution of the over-advanced ignition control and the intake-synchronized injection control (corresponding to regions in FIG. 2 where the ignition timing is advanced from point A), in place of the intake-synchronized injection control (that is, control for causing the entire amount of the to-be-injected fuel to undergo the intake-synchronized injection), the present apparatus performs processing for causing a portion of the to-be-injected fuel to undergo the intake-unsynchronized injection rather than the intake-synchronized injection, to thereby reduce the amount of fuel which undergoes the intake-synchronized injection. Hereinafter, such processing will be referred to as the "PM suppression processing."

As indicated by solid lines in FIG. 2, through execution of the PM suppression processing, the PM emission amount can be suppressed to the PM permissible amount even when the ignition timing is advanced from point A (see the lower graph of FIG. 2). Notably, through execution of the PM suppression processing, the HC emission amount increases slightly, as compared with the case where the intake-synchronized injection control is executed (see the upper graph of FIG. 2). This phenomenon occurs because of the following reason. Through execution of the PM suppression processing, the amount of the intra-cylinder-adhering fuel decreases, and the amount of the port-adhering fuel increases. However, an increase in the "emission amount of HC derived from the port-adhering fuel" is considerably larger than a decrease in the "emission amount of HC derived from the intra-cylinder-adhering fuel."

Next, actual operation of the CPU 71 for the HC reduction control, including the PM suppression processing, will be described with reference to a flowchart shown in FIG. 4.

(Actual Operation)

Figure 4:
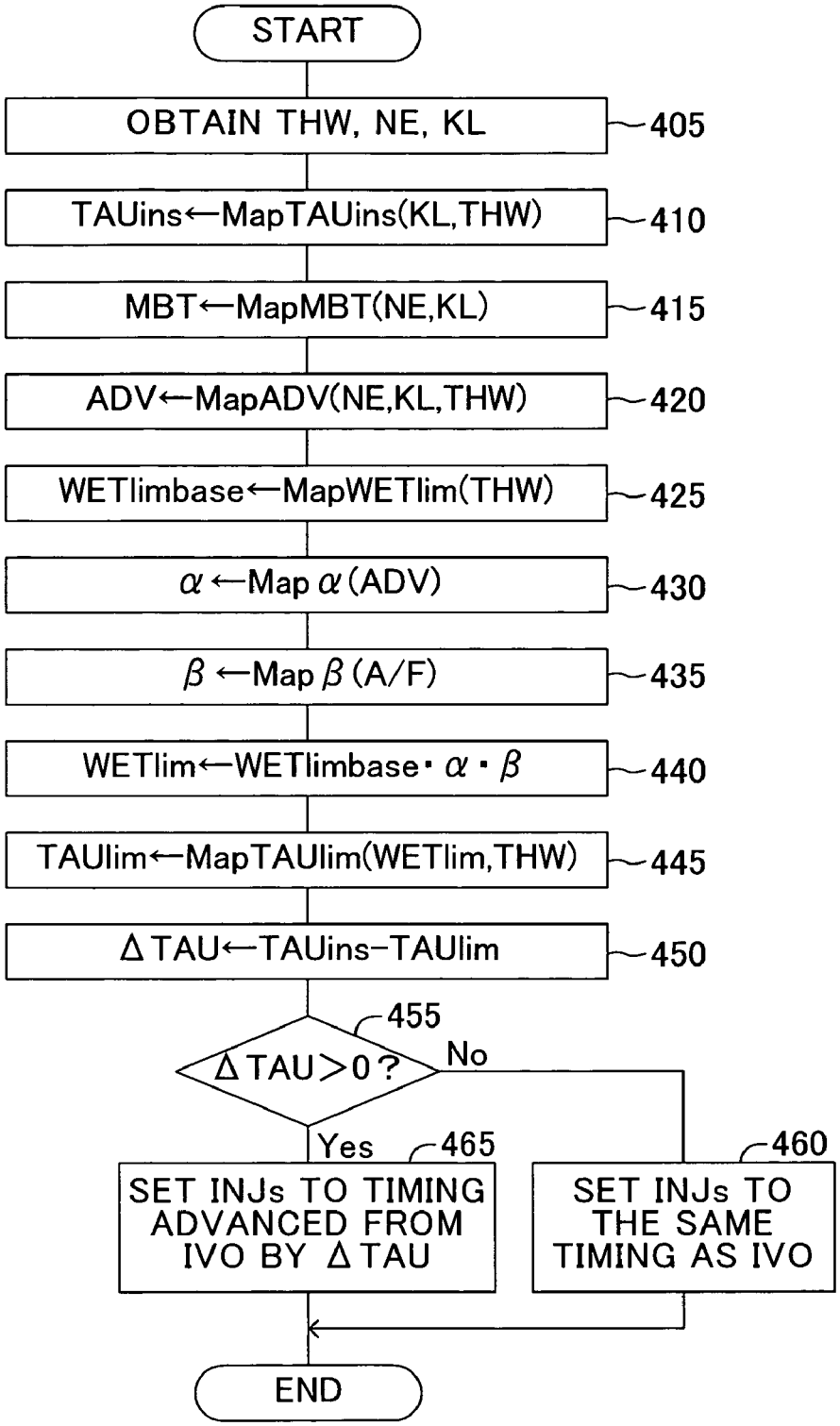
FIG. 4 is a flowchart showing a routine which is executed by a CPU shown in FIG. 1 so as to execute HC reduction control, including PM suppression processing.

Only in a period in which a predetermined low-temperature startup state is established, the CPU 71 repeatedly executes, for each cylinder, the routine shown in FIG. 4 and adapted to perform the HC reduction control, including the PM suppression processing, every time a predetermined timing in the exhaust stroke comes.

In the present example, the start condition of the predetermined low-temperature startup state is satisfied when the cooling water temperature THW is equal to or lower than a predetermined value and the engine rotational speed NE exceeds a first rotational speed (corresponding to so-called complete explosion) immediately after startup of the engine. Notably, the condition regarding the engine rotational speed NE may be modified such that the condition is determined to be satisfied when the engine rotational speed NE exceeds a second rotational speed higher than the first rotational speed. This reliably prevents occurrence of a situation in which the engine rotates in the reverse direction as a result of the over-advanced ignition control.

Further, in the present example, the end condition of the predetermined low-temperature startup state is satisfied when a cumulative value ΣGa of the intake air flow rate Ga from the startup of the engine exceeds a predetermined value. Means for determining whether or not the predetermined low-temperature startup state is established as described above corresponds to the above-described "determination means."

In a period immediately after the startup of the engine in which the start condition of the predetermined low-temperature startup state has not yet been satisfied, the ignition timing of the spark plug 37, the fuel injection start timing (timing at which the injector 39 starts to open), and the fuel injection amount (the open time of the injector 39) are determined on the basis of, for example, the cooling water temperature THW only.

When the start condition of the predetermined low-temperature startup state is satisfied, the CPU 71 proceeds to step 405, and acquires, for a cylinder for which fuel injection is performed (fuel injection cylinder), the cooling water temperature THW from the water temperature 65, the engine rotational speed NE from the crank position sensor 64, and a load factor KL calculated from the engine rotational speed NE and the intake air flow rate Ga acquired from the air flowmeter 61.

Next, the CPU 71 proceeds to step 410, and determines an instruction open time TAUins (corresponding to the above-mentioned "entire amount of the to-be-injected fuel") of the injector 39 on the basis of the acquired load factor KL and cooling water temperature THW, and a table MapTAUins in which KL and THW are used as arguments. Thus, the instruction open time TAUins is set such that the greater the load factor KL, the longer the instruction open time TAUins, and the lower the cooling water temperature THW, the longer the instruction open time TAUins.

When the instruction open time TAUins is determined, the load factor KL is used to calculate a fuel amount required to render the air-fuel ratio coincident with the stoichiometric air-fuel ratio, and the cooling water temperature THW is used to calculate an amount of fuel to be added so as to shift the air-fuel ratio toward the rich side (so-called startup increase amount for enrichment). The startup increase amount is set such that the lower the cooling water temperature THW, the greater the startup increase amount (that is, the greater the amount of shift of the air-fuel ratio toward the rich side).

Subsequently, the CPU 71 proceeds to step 415, and determines the MBT on the basis of the acquired engine rotational speed NE and load factor KL, and a table MapMBT in which NE and KL are used as arguments. In step 420 subsequent thereto, the CPU 71 determines an advancement amount ADV of the ignition timing from the MBT on the basis of the acquired engine rotational speed NE, load factor KL, and cooling water temperature THW, and a table MapADV in which NE, KL and THW are used as arguments.

Figure 5:
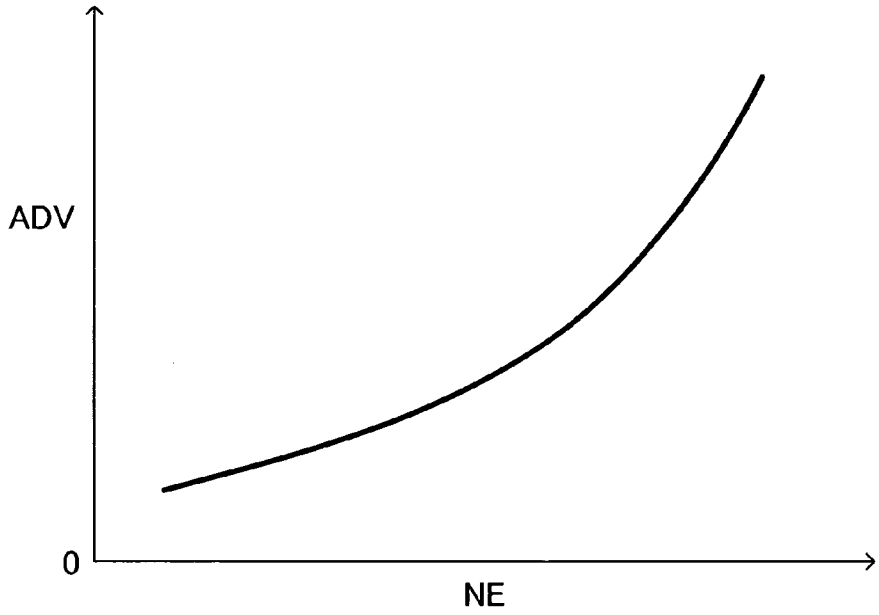
FIG. 5 is a graph showing a table which defines the relation between engine rotational speed and the amount of advancement of ignition timing from MBT, to which the CPU shown in FIG. 1 refers.
Figure 6:
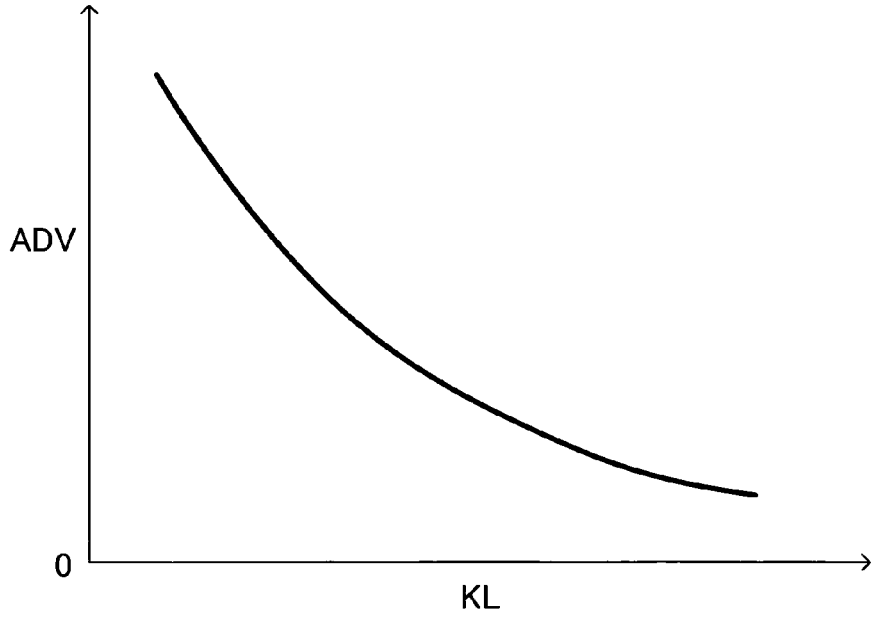
FIG. 6 is a graph showing a table which defines the relation between load factor and the amount of advancement of ignition timing from MBT, to which the CPU shown in FIG. 1 refers.
Figure 7:
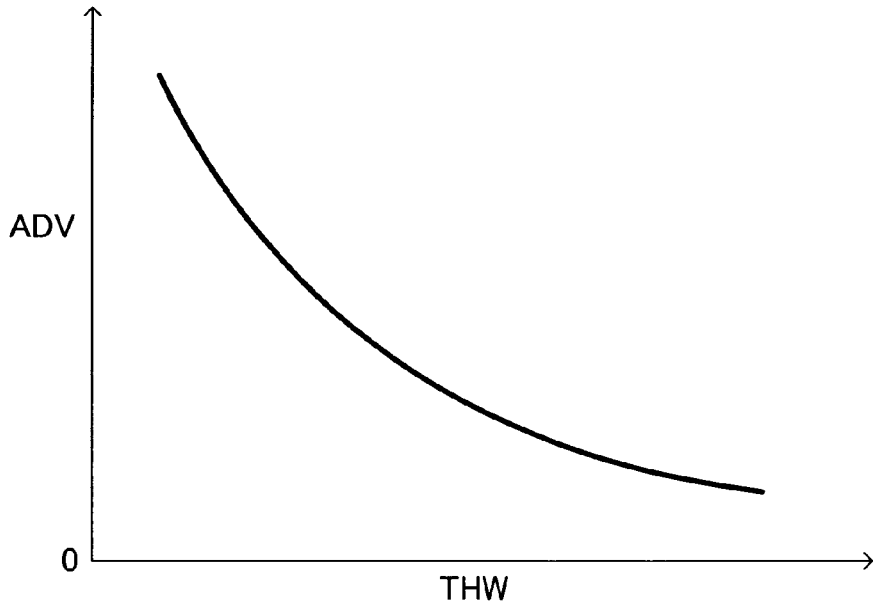
FIG. 7 is a graph showing a table which defines the relation between the temperature of cooling water and the amount of advancement of ignition timing from MBT, to which the CPU shown in FIG. 1 refers.

Thus, the advancement amount ADV is determined in accordance with characteristic curves shown in FIGS. 5 to 7. That is, as shown in FIG. 5, the advancement amount ADV is set such that the lower the engine rotational speed NE, the smaller the advancement amount ADV, in consideration of the fact that the lower the engine rotational speed NE, the longer the period in which the partial oxidation reaction of the intra-cylinder-adhering fuel can proceed, and the greater the amount by which the ignition timing can be delayed.

Further, as shown in FIG. 6, the advancement amount ADV is set such that the greater the load factor KL, the smaller the advancement amount ADV, in consideration of the fact that the greater the load factor KL, the greater the likelihood that a driver notices a drop in output torque of the engine due to the over-advanced ignition control.

Further, as shown in FIG. 7, the advancement amount ADV is set such that the lower the cooling water temperature THW, the larger the advancement amount ADV, in consideration of the fact that the lower the cooling water temperature THW, the greater the amount by which the air-fuel ratio is shifted to the rich side, whereby the amount of the intra-cylinder-adhering fuel increases.

Next, the CPU 71 proceeds to step 425, and determines a base value WETlimbase for an intra-cylinder-adhering-fuel-amount permissible. value WETlim on the basis of the acquired cooling water temperature THW and a table MapWETlim in which THW is used as an argument. This base value WETlimbase is an intra-cylinder-adhering-fuel-amount permissible value WETlim corresponding to the case where the ignition timing coincides with the MBT (ADV=0) and the air-fuel ratio coincides with the stoichiometric air-fuel ratio.

The intra-cylinder-adhering-fuel-amount permissible value WETlim corresponds to the above-described "PM-emission-amount corresponding permissible value." That is, as described above, the PM emission amount increases with the amount of the intra-cylinder-adhering fuel. Accordingly, the PM emission amount can be suppressed to the PM permissible amount or less by means of suppressing the amount of the intra-cylinder-adhering fuel to a certain permissible value or the less. In view of the above, the intra-cylinder-adhering-fuel-amount permissible value WETlim can be used as the above-mentioned "PM-emission-amount corresponding permissible value."

Figure 8:
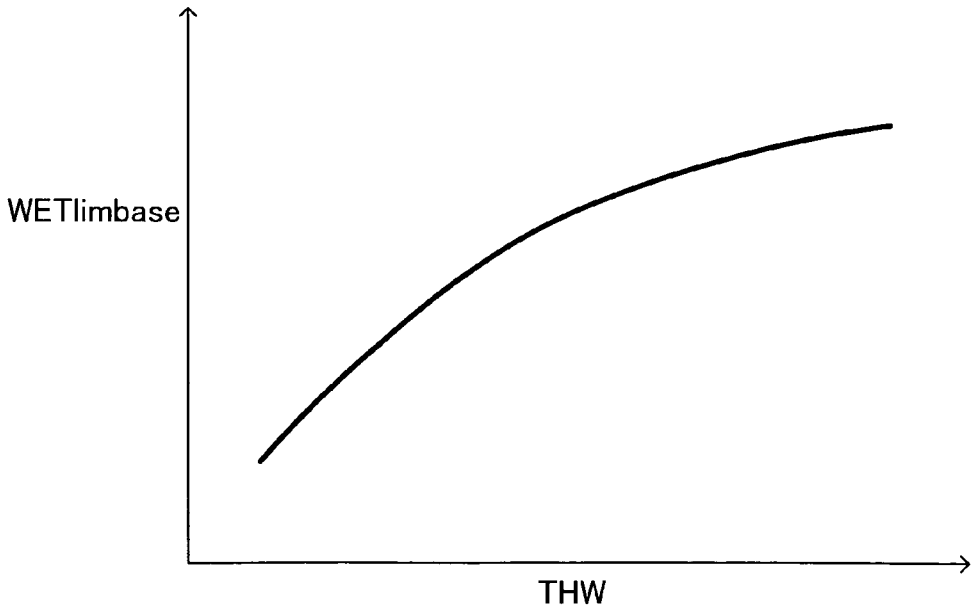
FIG. 8 is a graph showing a table which defines the relation between the temperature of cooling water and the base value of the intra-cylinder-adhering-fuel-amount permissible value, to which the CPU shown in FIG. 1 refers.

The base value WETlimbase for the intra-cylinder-adhering-fuel-amount permissible value is determined in accordance with a characteristic curve shown in FIG. 8. That is, the base value WETlimbase is set such that the higher the cooling water temperature THW, the greater the base value WETlimbase, in consideration of the fact that the higher the cooling water temperature THW, the greater the ratio of a portion of the intra-cylinder-adhering fuel which portion evaporates and undergoes combustion, whereby the ratio of a portion of the intra-cylinder-adhering fuel which portion substantially undergoes the partial oxidation reaction decreases (that is, the PM generation amount decreases).

Subsequently, the CPU 71 proceeds to step 430, and determines a first correction coefficient $\alpha$ (corresponding to the above-described "first correction value") on the basis of the determined advancement amount ADV and a table Map$\alpha$ in which ADV is used as an argument. The first correction coefficient $\alpha$ is used for obtaining the intra-cylinder-adhering-fuel-amount permissible value WETlim by correcting the base value WETlimbase. Specifically, the base value WETlimbase is multiplied by the first correction coefficient $\alpha$ so as to obtain the intra-cylinder-adhering-fuel-amount permissible value WETlim.

Figure 9:
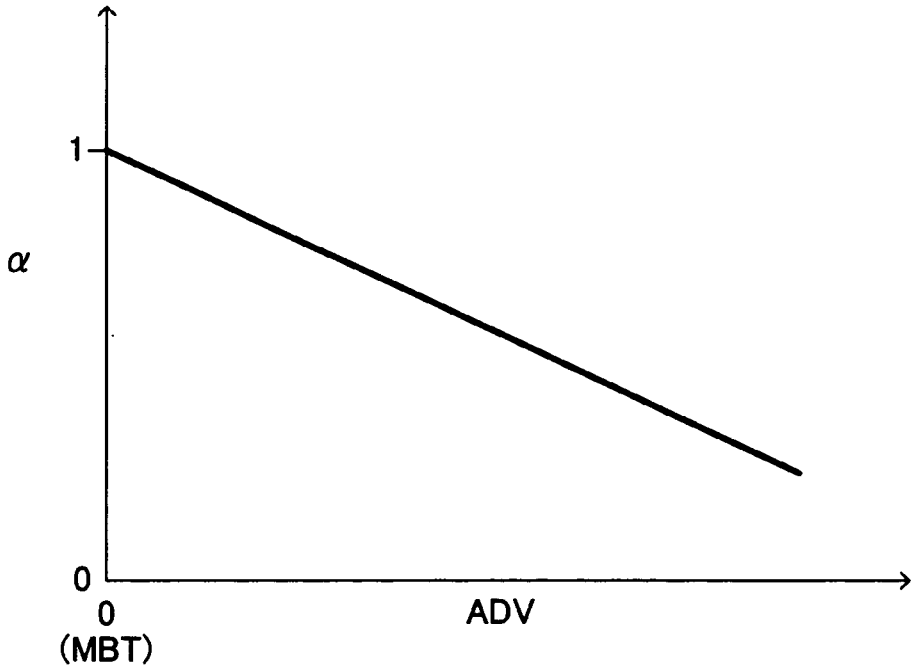
FIG. 9 is a graph showing a table which defines the relation between the amount of advancement and a first correction coefficient, to which the CPU shown in FIG. 1 refers.

This first correction coefficient $\alpha$ is determined in accordance with a characteristic curve shown in FIG. 9. That is, the first correction coefficient $\alpha$ is determined such that the first correction coefficient $\alpha$ becomes 1 when the advancement amount ADV is zero, and the greater the advancement amount ADV, the smaller the value of the first correction coefficient $\alpha$, in consideration of the fact that the greater the advancement amount ADV, the higher the peak of the intra-cylinder temperature, whereby the partial oxidation reaction of the intra-cylinder-adhering fuel is accelerated (that is, the PM generation amount increases).

Next, the CPU 71 proceeds to step 435, and determines a second correction coefficient $\beta$ (corresponding to the above-described "second correction value") on the basis of the air-fuel ratio A/F and a table Map$\beta$ in which A/F is used as an argument. The second correction coefficient $\beta$ is used to obtain the intra-cylinder-adhering-fuel-amount permissible value WETlim by correcting the base value WETlimbase. Specifically, the base value WETlimbase is multiplied by the second correction coefficient $\beta$ so as to obtain the intra-cylinder-adhering-fuel-amount permissible value WETlim. As the air-fuel ratio A/F, there is used an air-fuel ratio which is shifted from the stoichiometric air-fuel ratio toward the rich side by the startup increase amount taken into consideration when the instruction open time TAUins is determined.

Figure 10:
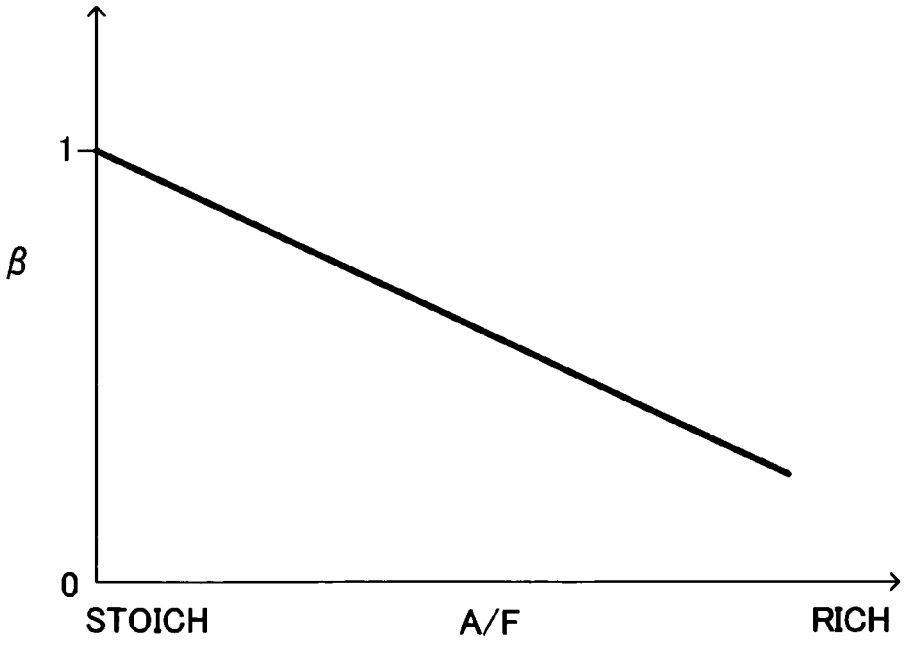
FIG. 10 is a graph showing a table which defines the relation between air-fuel ratio and a second correction coefficient, to which the CPU shown in FIG. 1 refers.

This second correction coefficient $\beta$ is determined in accordance with a characteristic curve shown in FIG. 10. That is, the second correction coefficient $\beta$ is determined such that the second correction coefficient $\beta$ becomes 1 when the air-fuel ratio A/F coincides with the stoichiometric air-fuel ratio (stoich), and the greater the amount of shift of the air-fuel ratio A/F from the stoichiometric air-fuel ratio toward the rich side, the smaller the value of the second correction coefficient $\beta$, in consideration of the fact that the greater the amount of shift of the air-fuel ratio A/F from the stoichiometric air-fuel ratio toward the rich side, the greater the amount of the intra-cylinder-adhering fuel, whereby the partial oxidation reaction of the intra-cylinder-adhering fuel is accelerated (that is, the PM generation amount increases).

Next, the CPU 71 proceeds to step 440, and determines the intra-cylinder-adhering-fuel-amount permissible value WETlim by multiplying the base value WETlimbase by the first and second correction coefficients $\alpha$ and $\beta$. Thus, the intra-cylinder-adhering-fuel-amount permissible value WETlim is set such that the value decreases from the base value WETlimbase as the advancement angle ADV increases from zero and the amount of shift of the air-fuel ratio A/F from the stoichiometric air-fuel ratio toward the rich side increases.

Next, the CPU 71 proceeds to step 445, and determines a permissible open time TAUlim on the basis of the determined intra-cylinder-adhering-fuel-amount permissible value WETlim, the cooling water temperature THW, and a table MapTAUlim in which WETlim and THW are used as arguments. The permissible open time TAUlim is an open time of the injector 39 corresponding to the amount of to-be-injected fuel (= the above-described "intake-synchronized-injection amount permissible value") corresponding to the case where the amount of the intra-cylinder-adhering fuel becomes equal to the determined intra-cylinder-adhering-fuel-amount permissible value WETlim when the intake-synchronized injection control is executed in the predetermined low-temperature startup state.

Figure 11:
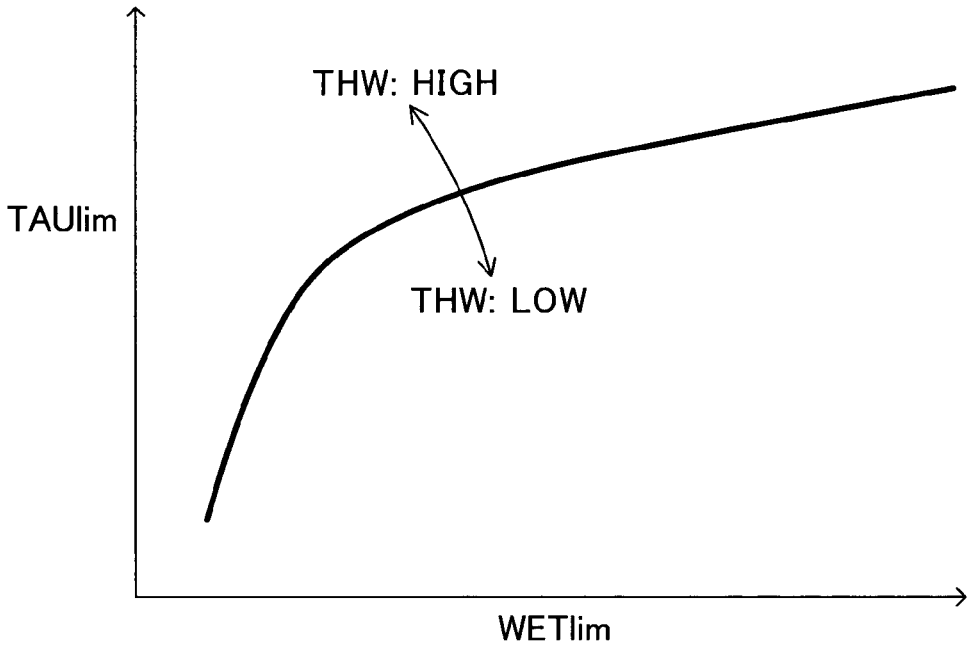
FIG. 11 is a graph showing a table which defines the relation between the intra-cylinder-adhering-fuel-amount permissible value and injector open time corresponding to the intake-synchronized-injection amount permissible value, to which the CPU shown in FIG. 1 refers.

The permissible open time TAUlim is determined in accordance with a characteristic curve shown in FIG. 11. This characteristic curve represents the relation between the fuel injection amount and the cooling water temperature, and the amount of the intra-cylinder-adhering fuel for the case where the intake-synchronized injection control is performed in the predetermined low-temperature startup state. This relation can be acquired in advance through an experiment, simulation, or the like. Thus, the permissible open time TAUlim is set such that the greater the intra-cylinder-adhering-fuel-amount permissible value WETlim and the higher the cooling water temperature THW, the longer the permissible open time TAUlim.

Next, the CPU 71 proceeds to step 450, and determines an open time deviation ΔTAU by subtracting the permissible open time TAUlim from the instruction open time TAUins. Next, the CPU 71 proceeds to step 455, and determines whether or not the open time deviation ΔTAU is positive. First, the case where the CPU 71 makes a "No" determination (ΔTAU≦0) will be described.

This case corresponds to the case where the entire amount of the to-be-injected fuel is equal to or less than the intake-synchronized-injection-amount permissible value. This means that, even when the entire amount of the to-be-injected fuel is caused to undergo the intake-synchronized injection, the amount of the intra-cylinder-adhering fuel becomes equal to or less than the intra-cylinder-adhering-fuel-amount permissible value WETlim, so that the PM emission amount does not exceed the PM permissible amount.

In this case, the CPU 71 proceeds to step 460 so as to set the start point INJs of the open period of the injector 39 such that the start point INJs coincides with the open timing IVO of the intake valve 32, and ends the processing of the present routine. That is, the entire amount of the to-be-injected fuel is caused to undergo the intake-synchronized injection. Thus, the HC emission amount can be reduced as much as possible within a range in which the PM emission amount does not exceed the PM permissible amount.

Next, the case where the CPU 71 makes a "Yes" determination in step 455 (ΔTAU>0) will be described. This case corresponds to the case where the entire amount of the to-be-injected fuel is greater than the intake-synchronized-injection-amount permissible value. This means that, when the entire amount of the to-be-injected fuel is caused to undergo the intake-synchronized injection, the amount of the intra-cylinder-adhering fuel exceeds the intra-cylinder-adhering-fuel-amount permissible value WETlim, so that the PM emission amount does exceed the PM permissible amount.

In this case, the CPU 71 proceeds to step 465 so as to set the start point INJs of the open period of the injector 39 to a point in time which is advanced from the open timing IVO of the intake valve 32 by the open time deviation ΔTAU, and ends the processing of the present routine. That is, fuel of an amount obtained by subtracting the intake-synchronized-injection-amount permissible value from the entire amount of the to-be-injected fuel, is caused to undergo the intake-unsynchronized injection, and fuel of an amount equal to the intake-synchronized-injection-amount permissible value is caused to undergo the intake-synchronized injection. Thus, the HC emission amount can be reduced as much as possible, while the PM emission amount is maintained at the PM permissible amount.

When the start point INJs of the open period set in step 460 or 465 comes, the CPU 71 instructs the injector 39 of the fuel injection cylinder to maintain its open state for the instruction open time TAUins determined in step 410. Further, when a timing which is advanced from the MBT determined in step 415 by the advancement amount ADV determined in step 420 comes after that, the CUP 71 instructs the spark plug 37 of the fuel injection cylinder to produce a spark.

When a "No" determination is made in step 455 (that is, the entire amount of the to-be-injected fuel is equal to or less than the intake-synchronized-injection-amount permissible value), in addition to the over-advanced ignition control, the intake-synchronized injection control is executed. Meanwhile, when a "Yes" determination is made in step 455 (that is, the entire amount of the to-be-injected fuel exceeds the intake-synchronized-injection-amount permissible value), while the over-advanced ignition control is continued, the above-described "PM suppression processing" (that is, the processing for causing a portion of the to-be-injected fuel to undergo the intake-unsynchronized injection and causing the remaining fuel to undergo the intake-synchronized injection) is executed in place of the intake-synchronized injection control.

The above-described processing is executed so long as the above-described predetermined low-temperature startup state is established. Accordingly, when the "end condition of the predetermined low-temperature startup state" is satisfied, the present apparatus starts and executes ordinary fuel injection control and ordinary ignition timing control. In the ordinary fuel injection control, for example, the entire amount of the to-be-injected fuel is caused to undergo the intake-unsynchronized injection, and the amount of the to-be-injected fuel is adjusted such that the air-fuel ratio coincides with the stoichiometric air-fuel ratio. Further, in the ordinary ignition timing control, for example, the MBT control (that is, control of setting the ignition timing to the MBT) is executed.

Moreover, in the case where the temperatures of the three-way catalysts 53 and 54 (in particular, the temperature of the three-way catalyst 53) have not yet reached a temperature corresponding to the activated state of the catalysts when the "end condition of the predetermined low-temperature startup state" is satisfied, the ignition timing may be delayed from the MBT for a predetermined short period of time. By virtue of this, a large amount of unburnt HC flows into the catalysts and undergoes an oxidation reaction, which is an exothermic reaction, whereby the catalysts can be heated intentionally.

In the above-described embodiment, steps 415, 420, and 460 of FIG. 4 correspond to the above-described HC reduction means; steps 425, 430, 435, and 440 of FIG. 4 correspond to the above-described permissible value acquisition means; and steps 455 and 465 of FIG. 4 correspond to the above-described restriction means.

As described above, according to the embodiment of the control apparatus for an internal combustion engine according to the present invention, in the predetermined low-temperature startup state (in a rich atmosphere), there are executed in principle the over-advanced ignition control for advancing the ignition timing beyond the MBT and the intake-synchronized injection control for causing the entire amount of the to-be-injected fuel to undergo the intake-synchronized injection. Thus, the peak of the intra-cylinder temperature increases, and the amount of the port-adhering fuel decreases, whereby the emission amount of unburnt HC can be reduced. Meanwhile, when the PM emission amount exceeds the PM permissible amount, instead of the intake-synchronized injection control, there is performed the PM suppression processing (processing for causing a portion of the to-be-injected fuel to undergo the intake-unsynchronized injection and causing the remaining fuel to undergo the intake-synchronized injection). Thus, the amount of the intra-cylinder-adhering fuel decreases, and the partial oxidation reaction of the intra-cylinder-adhering fuel, which is a cause of generation of PM, is suppressed. As a result, the PM emission amount decreases, whereby the PM emission amount can be suppressed to the PM permissible amount.

The present invention is not limited to the above-described embodiment, and various modifications can be employed within the scope of the present invention. For example, in the above-described embodiment, when the PM emission amount exceeds the PM permissible amount, the over-advanced ignition control is continued, and, in place of the intake-synchronized injection control, there is executed the processing for causing a portion of the to-be-injected fuel to undergo the intake-unsynchronized injection and causing the remaining fuel to undergo the intake-synchronized injection. However, the embodiment may be modified in such a manner as to continue the intake-synchronized injection control and execute processing for setting the advancement amount of the ignition timing from the MBT to an amount smaller than the advancement amount ADV set by the over-advanced ignition control (see step 420 of FIG. 4).

Thus, an increase in the peak of the intra-cylinder temperature is suppressed whereby the partial oxidation reaction of the intra-cylinder-adhering fuel is suppressed. As a result, the emission amount of PM can be prevented from exceeding the PM permissible amount. In this case, for example, an intra-cylinder-adhering-fuel-amount permissible value WETlim' is obtained on the basis of the instruction open time TAUins, the cooling water temperature THW, and the table TAUlim (see FIG. 11) such that the permissible open time TAUlim coincides with the instruction open time TAUins; and a first correction coefficient $\alpha'$ is obtained on the basis of the relation "$WETlim' = WETlimbase \cdot \alpha' \cdot \beta$," the base value WETlimbase, and the second correction coefficient $\beta$. Then, the advancement amount of the ignition timing from the MBT can be set to an advancement amount ADV' obtained from the first correction coefficient $\alpha'$ and the table Map$\alpha$ (see FIG. 9).

Further, in the case where the PM emission amount exceeds the PM permissible amount, there may be performed the processing for causing a portion of the to-be-injected fuel to undergo the intake-unsynchronized injection and causing the remaining fuel to undergo the intake-synchronized injection, and the processing for setting the advancement amount of the ignition timing from the MBT to an amount smaller than the advancement amount ADV set by the over-advanced ignition control.

In the above-described embodiment, the over-advanced ignition control and the intake-synchronized injection control are executed as the HC reduction control; however, only the over-advanced ignition control may be executed. In this case, when the PM emission amount exceeds the PM permissible amount, the processing for setting the advancement amount of the ignition timing from the MBT to an amount smaller than the advancement amount ADV set by the over-advanced ignition control can be executed.

In the above-described embodiment, when the PM suppression processing (processing for causing a portion of the to-be-injected fuel to undergo the intake-unsynchronized injection and causing the remaining fuel to undergo the intake-synchronized injection) is executed, the fuel to undergo the intake-unsynchronized injection and the fuel to undergo the intake-synchronized injection are continuously injected before and after the open timing of the intake valve 32. However, the fuel to undergo the intake-unsynchronized injection and the fuel to undergo the intake-synchronized injection may be injected separately (divided injection). In this case, for example, the end of the open period for the intake-unsynchronized injection is set to a timing before the open timing of the intake valve 32, and the start of the open period for the intake-synchronized injection is set to a timing coinciding with the open timing of the intake valve 32 or a timing after the open timing of the intake valve 32.

In the above-described embodiment, the advancement amount ADV is determined on the basis of the engine rotational speed NE, the load factor KL, and the cooling water temperature THW (see step 420 of FIG. 4). However, instead of the cooling water temperature THW, the startup increase amount of fuel calculated on the basis of the cooling water temperature THW in step 410 may be used to determine the advancement amount ADV.

Similarly, the second correction coefficient $\beta$ is determined on the basis of the air-fuel ratio A/F (see step 435 of FIG. 4). However, instead of the air-fuel ratio A/F, the startup increase amount of fuel calculated on the basis of the cooling water temperature THW in step 410 may be used to determine the second correction coefficient $\beta$.

In the above-described embodiment, the intra-cylinder-adhering-fuel-amount permissible value WETlim is determined by multiplying the base value WETlimbase for the intra-cylinder-adhering-fuel-amount permissible value WETlim by the first and second correction coefficients $\alpha$ and $\beta$. However, the embodiment may be modified to obtain first and second correction values $\gamma$ and $\eta$ which correspond to the first and second correction coefficients $\alpha$ and $\beta$ and have the dimension of the fuel amount, and add the first and second correction values $\gamma$ and $\eta$ to the base value WETlimbase for the intra-cylinder-adhering-fuel-amount permissible value WETlim, to thereby determine the intra-cylinder-adhering-fuel-amount permissible value WETlim.

The invention claimed is:

1. A control apparatus for a spark-ignition-type internal combustion engine comprising:

determination means for determining whether or not the internal combustion engine is in a predetermined low-temperature startup state;

HC reduction means, operable when the internal combustion engine is determined to be in the predetermined low-temperature startup state, for performing an HC reduction control which raises a temperature within a combustion chamber of the internal combustion engine through adjustment of a predetermined engine control parameter, to thereby reduce the emission amount of unburnt HC;

permissible value acquisition means for acquiring a PM-emission-amount corresponding permissible value, which is a permissible value for a value corresponding to the emission amount of PM; and restriction means for performing a restriction control which restricts execution of the HC reduction control on the basis of the PM-emission-amount corresponding permissible value, wherein the HC reduction means performs, as the HC reduction control, an over-advanced ignition control of setting an ignition timing to a timing advanced from an MBT, which is an ignition timing at which the maximum torque can be obtained.

2. A control apparatus for a spark-ignition-type internal combustion engine according to claim 1, wherein the HC reduction means performs, as the HC reduction control, the over-advanced ignition control and additionally an intake-synchronized injection control of setting a fuel injection period such that the entire amount of fuel to be injected into an intake passage located upstream of an intake valve is injected within a period during which the intake valve is opened.

3. A control apparatus for a spark-ignition-type internal combustion engine according to claim 2, wherein the restriction means performs, as the restriction control, a control of setting the fuel injection period such that a portion of the to-be-injected fuel is injected before the intake valve is opened, in place of the intake-synchronized injection control.

4. A control apparatus for a spark-ignition-type internal combustion engine according to claim 3, wherein the permissible value acquisition means acquires, as the PM-emission-amount corresponding permissible value, an intra-cylinder-adhering-fuel-amount permissible value, which is a permissible value for the amount of the intra-cylinder-adhering fuel adhering to the wall surface of the combustion chamber, on the basis of the amount of advancement from the MBT by the over-advanced ignition control; and the restriction means determines, as an intake-synchronized-injection-amount permissible value, an amount of fuel injected within the intake valve open period corresponding to the case where the amount of the intra-cylinder-adhering fuel becomes equal to the intra-cylinder-adhering-fuel-amount permissible value, on the basis of the acquired intra-cylinder-adhering-fuel-amount permissible value and a relation between the amount of the to-be-injected fuel and the amount of the intra-cylinder-adhering fuel, the relation being previously obtained for the case where the intake-synchronized injection control is executed in the predetermined low-temperature startup state, wherein, when the entire amount of the to-be-injected fuel is greater than the intake-synchronized-injection-amount permissible value, the restriction means sets the fuel injection period such that the fuel is injected before the intake valve is opened in an amount obtained by subtracting the intake-synchronized-injection-amount permissible value from the entire amount of the to-be-injected fuel, and is injected within the intake valve open period in an amount equal to the intake-synchronized-injection-amount permissible value.

5. A control apparatus for a spark-ignition-type internal combustion engine according to claim 4, wherein the permissible value acquisition means determines, on the basis of a temperature of cooling water of the internal combustion engine, a base value of the intra-cylinder-adhering-fuel-amount permissible value corresponding to the case where the ignition timing is the MBT; determines a first correction value for the intra-cylinder-adhering-fuel-amount permissible value on the basis of the amount by which the ignition timing is advanced from the MBT by the over-advanced ignition control; and acquires the intra-cylinder-adhering-fuel-amount permissible value on the basis of the base value of the intra-cylinder-adhering-fuel-amount permissible value and the first correction value.

6. A control apparatus for a spark-ignition-type internal combustion engine according to claim 5, wherein the permissible value acquisition means sets the base value of the intra-cylinder-adhering-fuel-amount permissible value to a value corresponding to the case where the ignition timing is the MBT and the air-fuel ratio is the stoichiometric air-fuel ratio; determines a second correction value for the intra-cylinder-adhering-fuel-amount permissible value on the basis of the air-fuel ratio; and acquires the intra-cylinder-adhering-fuel-amount permissible value on the basis of the base value of the intra-cylinder-adhering-fuel-amount permissible value and the first and second correction values.

7. A control apparatus for a spark-ignition-type internal combustion engine according to claim 1, wherein the restriction means performs, as the restriction control, a control of rendering the amount of advancement of the ignition timing from the MBT smaller than the amount of advancement by the over-advanced ignition control.

* * * * *